United States Patent [19]

McGuerty

[11] 4,308,781

[45] Jan. 5, 1982

[54] SAXOPHONE MOUTHPIECE HAVING BOUNDARY LAYER CONTROL MEANS

[76] Inventor: Jay S. McGuerty, 21 E. Lakeshore Dr., Apartment 3, Cincinnati, Ohio 45237

[21] Appl. No.: 202,685

[22] Filed: Oct. 31, 1980

[51] Int. Cl.[3] ..... G10D 9/02

[52] U.S. Cl. ..... 84/383 R

[58] Field of Search ..... 84/383 R

[56] References Cited

U.S. PATENT DOCUMENTS

| | | | |
|---|---|---|---|
| 1,101,420 | 6/1914 | Erdahl | 84/383 R |
| 1,748,077 | 2/1930 | Packman et al. | 84/383 R |
| 2,368,556 | 1/1945 | Maccaferri | 84/383 R |
| 2,456,299 | 12/1948 | Miller | 84/383 R |
| 2,496,749 | 2/1950 | Reddick | 84/383 R |
| 3,150,554 | 9/1964 | Leloup | 84/383 R |

*Primary Examiner*—Lawrence R. Franklin

*Attorney, Agent, or Firm*—Frost & Jacobs

[57] ABSTRACT

One or more openings are provided through the tip sealing surface of a woodwind musical instrument mouthpiece to control and modify the boundary layer conditions between the reed and the tip sealing surface to improve ease of playing and the tonal characteristics of the mouthpiece. The openings may comprise a plurality of spaced circular apertures, or slots extending through the tip sealing surface, or a generally continuous elongated slot extending approximately the entire width of the tip sealing surface. The axis of the apertures or slots may be oriented to provide the desired operating characteristics.

10 Claims, 10 Drawing Figures

SAXOPHONE MOUTHPIECE HAVING BOUNDARY LAYER CONTROL MEANS

SUMMARY OF THE INVENTION

The present invention is directed to musical instruments, and more particularly to means for improving the performance of mouthpieces for single reed musical instruments such as saxophones and the like.

As is well known in the art, the sound produced by a woodwind instrument such as a saxophone is created by a vibrating column of air established within the instrument body by the rapid opening and closing of the flexible reed positioned on the mouthpiece. In effect, the vibrating reed held to the mouthpiece body by means of the ligature acts as a valve to periodically interrupt the flow of air from the performer's mouth into the mouthpiece to produce the vibrating column of air.

In general, it has been found that improving the efficiency of the valve action produced by the vibrating reed also improves the tonal quality of the musical instrument since the performer may exercise greater control over the reed with less effort.

The present invention is directed to improving the efficiency of the mouthpiece by controlling boundary layer conditions at the interface between the reed and the mouthpiece tip sealing surface. In a preferred embodiment, this objective is accomplished by placing a plurality of closely spaced apertures along the outer tip sealing surface adjacent the reed. These apertures permit air normally trapped between the reed and the mouthpiece which acts as a cushion preventing vibration of the reed to escape, thus permitting the reed to seal more rapidly against the mouthpiece sealing surface. In addition, after the reed has sealed the apertures, air pressure within the mouth cavity at greater than ambient pressure returns through the apertures to act as an additional force to move the reed away from the mouthpiece sealing surface. Positioning the holes at the outer tip of the mouthpiece permits the greatest leverage to be exerted against the reed, to significantly effect the tonal characteristics of the instrument.

In an alternate embodiment, the apertures are replaced by one or more slots extending through the outer tip sealing surface of the mouthpiece to modify and control the boundary layer conditions at the interface of the reed and the mouthpiece.

As will become apparent from the detailed description which follows, the present invention permits significant improvement in ease of playing of the instrument, as well as the tonal characteristics. Furthermore, the sound and playing characteristics of the instrument may be modified by varying the size, shape, number and location of the holes or slots.

Further features will become apparent from the detailed description which follows.

DETAILED DESCRIPTION

Figure 1:
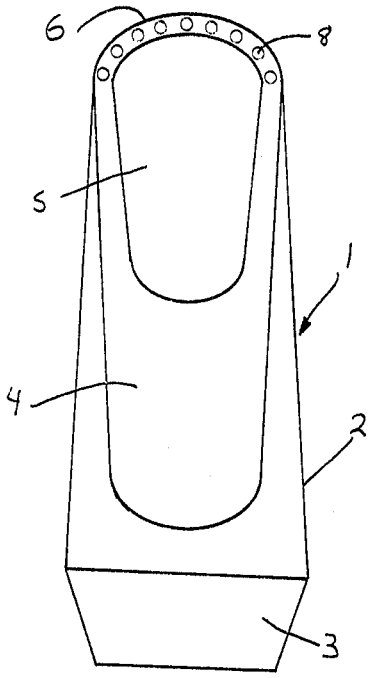
FIG. 1 is a bottom plan view of the woodwind mouthpiece of the present invention utilizing spaced apertures.
Figure 2:
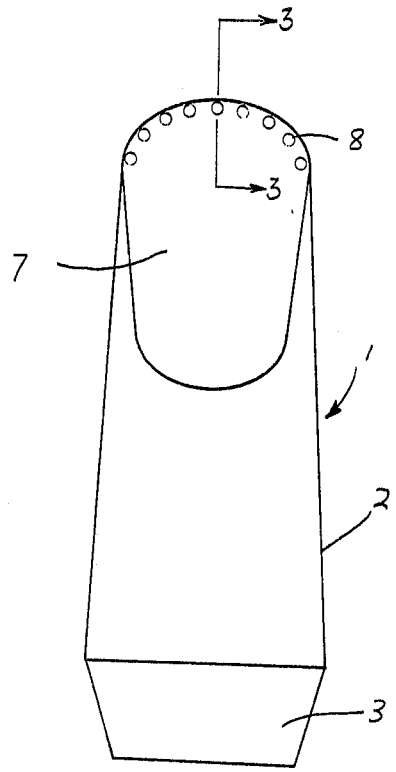
FIG. 2 is a top plan view of the mouthpiece illustrated in FIG. 1.

A first embodiment of the improved mouthpiece of the present invention is illustrated generally at 1 in FIG. 1 and FIG. 2. Mouthpiece 1 is similar in construction to conventional woodwind mouthpieces and includes a generally tubular body 2 having a lower instrument engaging end 3, a lay or flat face 4 for mounting a reed (not shown) and an opening 5 positioned on face 3 communicating with the tone chamber within the mouthpiece. The arcuate upper edge of face 4 defines the outer tip sealing surface 6 of the mouthpiece. As is well understood in the art, a suitable reed may be positioned on face 4 and held in place by a ligature (not shown). The upper surface of mouthpiece 1 defines the usual tapered front wall 7 as illustrated in FIG. 2. In general, the mouthpiece 1 just described is conventional in construction.

Figure 3:
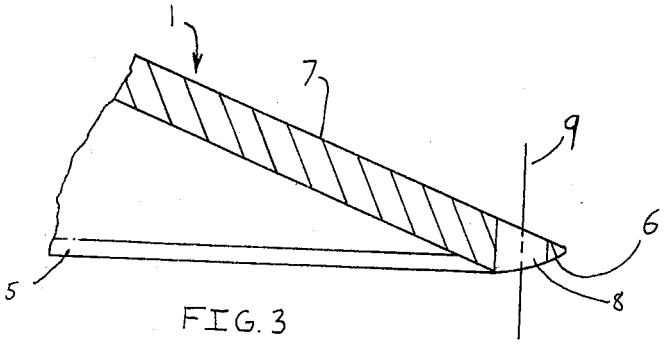
FIG. 3 is a fragmentary cross sectional view taken along section line 3—3 of FIG. 2.

In order to modify and control the boundary layer conditions at the interface of the reed and the mouthpiece, tip sealing surface 6 is provided with a plurality of openings or apertures, one of which is shown at 8, extending completely through the tip sealing surface along an axis 9 (see FIG. 3) generally perpendicular to the longitudinal axis of mouthpiece 1.

Figure 6:
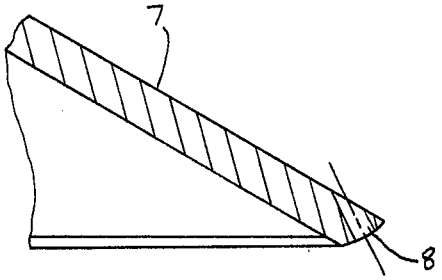
FIG. 6–FIG. 7 are fragmentary cross sectional views of the mouthpiece tip sealing surface illustrating angled apertures.
Figure 7:
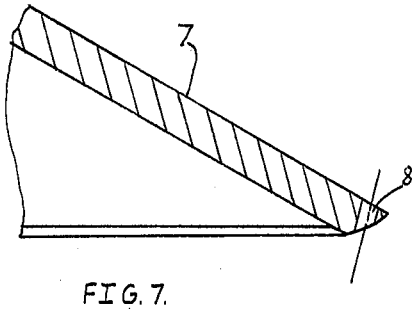

Although for purposes of an exemplary showing, apertures 8 are illustrated as generally circular in cross section, it will be understood that various shapes may be used to provide the particular tonal qualities desired. Furthermore, as illustrated in FIG. 6 and FIG. 7, the axis of apertures 8 may be inclined with respect to the longitudinal axis of mouthpiece 1.

Figure 4:
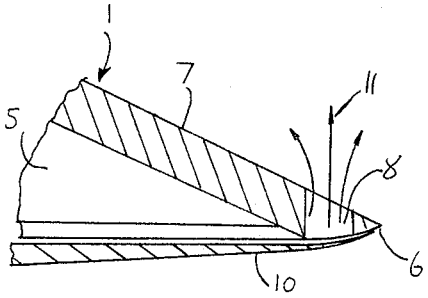
FIG. 4 is a fragmentary cross sectional view of the mouthpiece tip sealing surface with a reed in the closed position.
Figure 5:
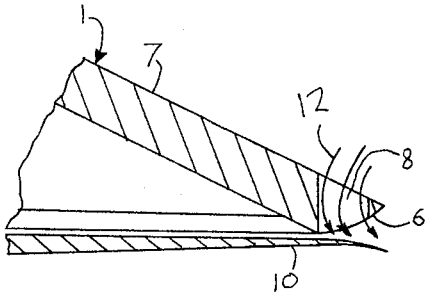
FIG. 5 is a fragmentary cross sectional view of the mouthpiece tip sealing surface with a reed in the opened positioned.

FIG. 4 and FIG. 5 illustrate the tip sealing surface portion 6 of mouthpiece 1 with a suitable conventional woodwind reed 10 in place against face 4. In FIG. 4, reed 10 is illustrated in the closed position where the lowermost opening of aperture 8 and the forward edge of the tip sealing surface 6 are sealed by the reed. It will be observed that air normally trapped between reed 10 and the adjacent portion of tip sealing surface 6, which serves to act as a cushion to hold the reed in the closed position, is permitted to escape or bleed through apartures 8 as illustrated by directional arrows 11. This enables reed 10 to seal more rapidly against the mouthpiece sealing surface.

In FIG. 5, reed 10 has begun moving away from tip sealing surface 6. It will be observed that air pressure from within the mouth cavity at higher than ambient pressure moving in the direction of directional arrows 12 flows back through apertures 8 to act as an additional force to push reed 10 away from the tip sealing surface.

Consequently, the rebound time of the reed is significantly reduced.

It will be observed that both of these functions serve to improve the valving characteristics of valve 10 by modifying or controlling boundary layer conditions at the interface of the reed and mouthpiece, and consequently make the musical instrument easier to play, and at the same time improve the tonal characteristics. It has been found that the brilliance and nasal quality of the musical instrument tone is improved with the present invention. In addition, it will be understood that by varying the size, shape, number, location and orientation of apertures 8, the sound and playing characteristics of the instrument may be controlled. In addition, apertures 8 may be provided along the edges of the tip sealing surface adjacent the side edges of opening 5, although this type of construction will generally not be necessary since reed 10 is usually stiffer in these areas.

Figure 8:
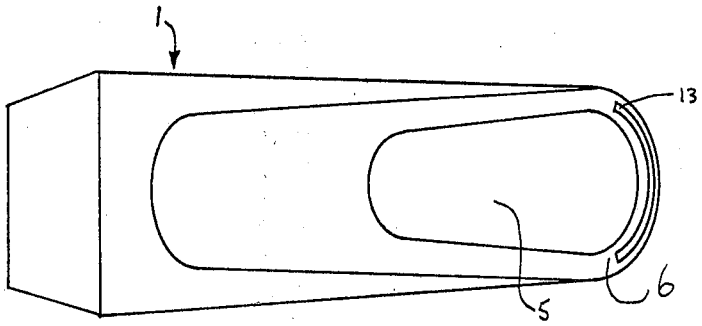
FIG. 8 is a bottom plan view of a second embodiment of the mouthpiece of the present invention illustrating a slotted tip sealing surface.
Figure 9:
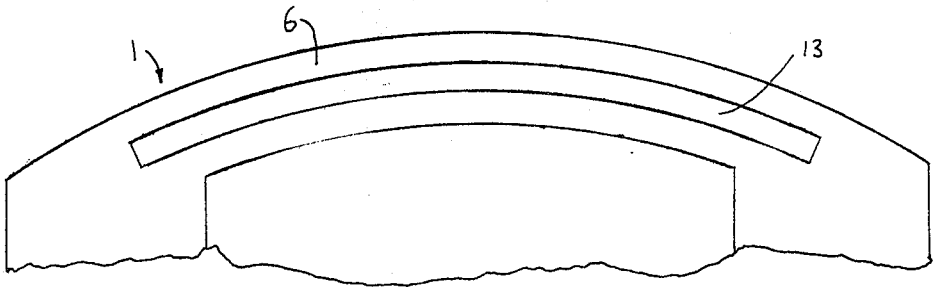
FIG. 9 is an enlarged fragmentary top plan view of the mouthpiece tip of the embodiment of FIG. 8.

A second embodiment of the present invention is illustrated in FIG. 8 and FIG. 9 wherein apertures 8 have been replaced by a single elongated arcuate slot 13 extending completely through tip sealing surface 6. As is best shown in FIG. 9, slot 13 will be dimensioned to provide the necessary modification of the boundary conditions between the reed and mouthpiece interface, while maintaining the structural integrity of tip sealing surface 6. If desired, slot 13 may be divided into a plurality of spaced slots extending the width of the mouthpiece tip. In addition, further modification may be made to the size and shape of the slot, and the central axis oriented as illustrated, for example, in FIG. 6 and FIG. 7.

Figure 10:
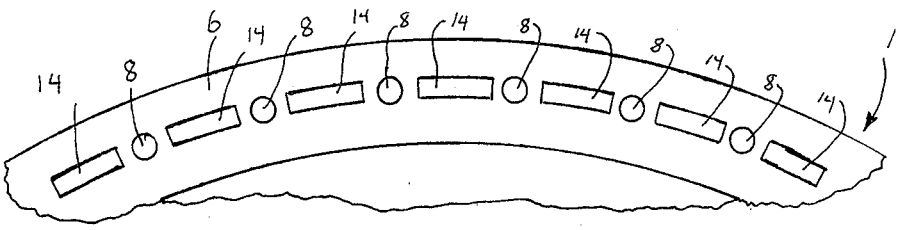
FIG. 10 is an enlarged fragmentary top elevation view of an alternate mouthpiece tip having a combination of slots and aperture.

Another embodiment of the present invention is illustrated in FIG. 10, where alternating combinations of apertures 8 and shortened slots 14 extending completely through tip sealing surface 6 have been used. In general, apertures 8 and slots 14 will be dimensioned and positioned to produce the operating characteristics described above. In addition, other opening shapes may be utilized as required.

It will be understood that various changes in the details, materials, steps and arrangements of parts, which have been herein described and illustrated in order to explain the nature of the invention, may be made by those skilled in the art within the principle and scope of the invention as expressed in the appended claims.

The embodiments of the invention in which an exclusive property or privilege is claimed are as follows:

1. In a mouthpiece for woodwind musical instruments of the type comprising a hollow member having a mouth engaging end terminating in a generally arcuate edge and a lower face extending forwardly of said edge configured to mount a reed, the interior of said member defining a tone chamber, and a centrally positioned opening extending through said face and communicating with said tone chamber, the portion of said face positioned between said opening and said edge defining a tip sealing surface, the improvement in combination therewith comprising at least one opening extending through said tip sealing surface.

2. The mouthpiece according to claim 1 wherein said said at least one opening comprises a plurality of generally circular apertures arranged in spaced side-by-side relationship extending through said tip sealing surface, the axis of said openings being substantially perpendicular to said reed mounting face.

3. The mouthpiece according to claim 1 wherein the axis of said opening is substantially perpendicular to said reed mounting face.

4. The mouthpiece according to claim 1 wherein the axis of said opening is substantially perpendicular to said tip sealing surface.

5. The mouthpiece according to claim 1 including a plurality of openings spaced side-by-side extending through said tip sealing surface.

6. The mouthpiece according to claim 1 wherein said opening comprises an elongated slot.

7. The mouthpiece according to claim 6 wherein said slot extends in spaced parallel relationship to said mouthpiece edge substantially the width of said tip sealing surface.

8. The mouthpiece according to claim 6 including a plurality of slots spaced in end-to-end relationship.

9. The mouthpiece according to claim 1 including a plurality of generally circular apertures arranged in spaced side-by-side relationship extending through said tip sealing surface.

10. The mouthpiece according to claim 1 including a plurality of apertures spaced in side-by-side relationship and a plurality of slots spaced in end-to-end relationship adjacent said apertures extending through said tip sealing surface.

* * * * *